United States Patent [19]

Marsiletti

[11] Patent Number: 4,938,465

[45] Date of Patent: Jul. 3, 1990

[54] METHOD AND DEVICE FOR SEPARATING A PREDETERMINED NUMBER OF FLAT OBJECTS, SUCH AS SHEETS OF PAPER

[75] Inventor: Gianni Marsiletti, Oggiono, Italy

[73] Assignee: OMET S.r.L., Italy

[21] Appl. No.: 204,071

[22] Filed: Jun. 8, 1988

[30] Foreign Application Priority Data

Jun. 10, 1987 [IT] Italy ..... 20861 A/87

[51] Int. Cl.[5] ..... B65H 41/00

[52] U.S. Cl. ..... 270/52.5; 270/21.1; 270/39; 493/412; 493/359

[58] Field of Search ..... 270/21.1, 39, 40, 41, 270/52, 52.5, 95; 493/356, 357, 359, 412

[56] References Cited

U.S. PATENT DOCUMENTS

| | | | |
|---|---|---|---|
| 4,597,748 | 7/1986 | Wolf | 493/357 |
| 4,721,295 | 1/1988 | Hathaway | 270/52.5 |
| 4,770,402 | 9/1988 | Couturier | 270/39 |

FOREIGN PATENT DOCUMENTS

| | | | |
|---|---|---|---|
| 372031 | 3/1923 | Fed. Rep. of Germany | 270/39 |
| 104870 | 6/1983 | Japan | 270/52.5 |

*Primary Examiner*—Robert E. Garrett
*Assistant Examiner*—Therese M. Newholm
*Attorney, Agent, or Firm*—Lerner, David, Littenberg, Krumholz & Mentlik

[57] ABSTRACT

Downstream of a paper leaf stacking machine, e.g. a paper napkin folder, there is a device comprising supports on each of which is mounted at least one leaf separating finger.

Each support is kept, by a stop, in a fixed position corresponding to that in which the paper folder forms and deposits the folded leaves. After a predetermined number of leaves have been deposited, the stop is disengaged and the finger is snapped in between one sheet and the next and so advances at least part of the way with the stack of folded sheets. At a certain point of the path, each pack of leaves, as marked by two successive fingers, is lifted out by a forceps or the like and each support is returned to its starting position.

21 Claims, 2 Drawing Sheets

METHOD AND DEVICE FOR SEPARATING A PREDETERMINED NUMBER OF FLAT OBJECTS, SUCH AS SHEETS OF PAPER

BACKGROUND OF THE INVENTION

1. Field of the Invention

The present invention concerns a method and a device for separating a predetermined number of flat objects, such as leaves stacked by a paper folder machine. In more detail, the present invention concerns the separation of paper leaves during their production and folding, to mechanically obtain packs of a predetermined number of paper napkins or the like.

The following description will refer to paper napkins by way, of example but the invention is not limited to thereto.

2. Description of the Prior Art

At present, paper napkins are produced by a paper folding machine which comprises two counter rotating rollers, a feed system and a knife.

The paper ribbon fed onto the rollers from a spool is gripped by a forceps on one of the rollers and pulled between the rollers and beyond, on the surface of said one roller, to a certain position wherein the grip of the forceps is released and the paper is left folded. A similar forceps on the other roller performs a similar operation in its turn, forming a similar folded loop on its side beyond the pair of rollers, and the process continues, depositing paper loops in turn to the left and to the right, below the area of contact with the rollers, creating a zig-zag folded ribbon. Feeders, comprising curved rods or the like, are housed in recessed grooves in the rollers and are moved out of the grooves after the formation of every loop, to distance the loops already formed in the paper ribbon from the roller, making way for new loops being folded and pushing the folded loops against a knife which cuts them in half thus forming two adjacent stacks of folded napkins.

As the above description shows, the operation up to this point is entirely mechanical and can be performed at a high production rate. The problem arises when the napkins have to be removed and sorted into packs of a fixed and pre-determined number of napkins. This stage is at present carried out manually, and the number of napkins in every pack is determined by empirical, time consuming and not very reliable methods.

There is the need for a method and a related device which allows the automation of this final part of the operation.

OBJECTS OF THE INVENTION

An object of the present invention is to satisfy the above requirement, by providing a device and a method for separating folds or leaves of paper in the stacking phase to define packs of a predetermined number of napkins or the like, or in general, a method and device for separating flat objects and creating packs of a predetermined number of the same, downstream of a counter-rotating roller folder machine.

SUMMARY OF THE INVENTION

The present invention therefore concerns a method and device for separating flat objects one from the other, in particular folds or sheets of paper or the like being fed from a folder machine of the type using rollers to fold a ribbon of paper or the like into loops which are then cut to give single folded sheets, the method being characterized by the following steps: blocking by a stop at least one support with a finger for separating sheets or loops, in a fixed position outside the space taken up by the ribbon in the folding phase; keeping such support and separating finger in position by said stop for the time necessary to form a predetermined number of loops, beginning from a starting loop; extracting the stop on command, freeing the finger after the last loop formed, in order to insert the same between that and the next loop; advancing the finger and support along a first path portion parallel to that of the loops or sheets obtained from said loops, substantially at the same speed as said sheets; extracting a pack formed by said predetermined number of sheets, as defined by the sheets between said finger and the preceding one; returning the finger to the starting position along a return path portion; said steps being carried out simultaneously and successively by a plurality of separating fingers having a distance from one another corresponding to said predetermined number of sheets or loops.

The invention further concerns a device for separating a predetermined number of flat objects, in particular folded sheets of paper or the like being fed from a folder of the type using rollers to fold a ribbon of paper or the like into loops which are then cut to form single folded sheets, such device being characterized in that it comprises one or more supports, each having at least one sheet separating finger; a stop to keep the support and finger or fingers in a waiting position behind the loop formation area, said stop being extractable on command to allow the finger or fingers to be brought into an operating position separating the loops; and means to move the support or supports along a closed path, having at least a portion parallel to the stack of folded sheets. The method and device will now be described in greater detail with reference to the enclosed drawings, of an illustrative but not limitative nature, in which:

DESCRIPTION OF THE PREFERRED EMBODIMENT

Figure 2:
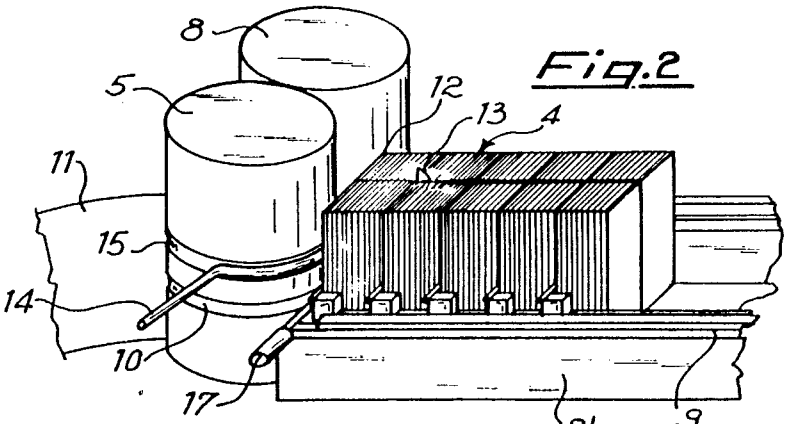
FIG. 2 is a perspective view of the embodiment shown in FIG. 1.
Figure 3:
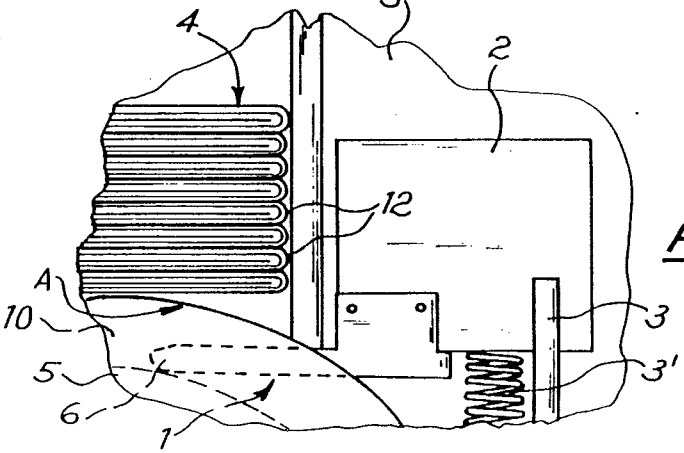
FIG. 3 is an enlarged partial top view of an embodiment of a separating finger, stopped at a folding roller.
Figure 1:
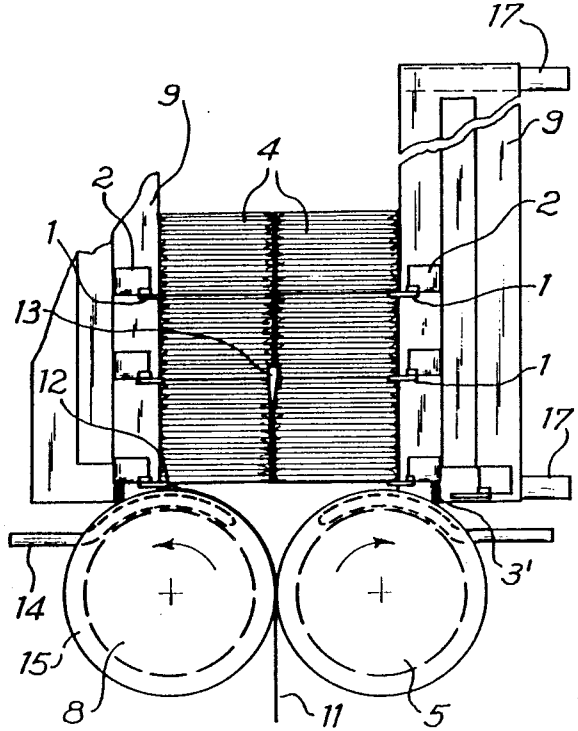
FIG. 1 is a schematic top view of a possible embodiment of the invention.

With reference to FIGS. 1, 2 and 3, a ribbon of paper 11, which in the exemplified embodiment of napkin formation is already folded in half longitudinally, is folded in "zig-zag" fashion by a known technique. According to this technique, the ribbon 11 is gripped by a forceps (not shown), on one of two counter-rotating rollers 5 and 8, for example roller 5, and is pulled through the rollers 5 and 8 and on the side wall of roller 5, up to a certain position where it is released by the forceps. This position corresponds more or less to that indicated by A in FIG. 3. A folded loop is thus formed.

In the meantime a second forceps on the other roller, i.e. roller 8, carries out a similar operation, releasing the ribbon 11 in a position corresponding and specular to that shown by A and forming a second, opposite loop. At every rotation of the rollers 5 and 8 two loops 12 are formed (one for each roller) which are inserted under the already formed loops.

To make room for the new loops arriving, the loops 12 already formed are kept away from rollers 5 an 8 by curved non-rotating pressure-bars 14, housed in circumferential recesses 15 in the surface of the same rollers. In detail, said pressure-bars 14, after each new loop has been formed, have an alternating movement coming out of recesses 15 to push the loops 12 of the folded ribbon 11 forward against a knife 13, which may be situated immediately near the first loop, or, as in FIGS. 1 to 3, some way behind. The knife 13 therefore cuts the folded ribbon transforming the loops 12 into a double stack of napkins 4.

In the meantime, the pressure-bars 14 are returned to the recess 15 to leave the space free for a new loop which will be deposited there.

Preferably the napkins should bear against an advancing support (not shown), on which they retreat from rollers 5 and 8 at a speed predetermined by the production rate. The basic concept of the invention is to define a pack of a predetermined number of napkins 4, separating two napkins by the insertion, at fixed intervals, of separating fingers 1, which thereafter move with the same napkins and at the same speed, along a predetermined path portion 9, at the end of which a forceps, or similar device, removes a pack containing said predetermined number of napkins, as defined by the distance between succeeding fingers 1.

A particular embodiment of the invention is shown in FIGS. 1 to 3, in which each finger 1 is mounted on a support 2 (several fingers could possibly be mounted on the same support) moving along a path 9. The supports 2 are moved along said predetermined path 9 by any kind of conveying means to which the supports are connectable through a coupling and uncoupling device, allowing the supports to be connected to or disconnected from a conveying means, to determine the support advance or stop according to the requirements.

During the operation a first support 2 is brought to a stand-by or starting position close to each 5 and 8 roller and is kept fixed there by a stop 3 which engages the support 2 and tensions a spring 3' located in the support 9', behind the support 2 in stand-by position. In this condition the tip 6 of finger 1 rests in a circumferential groove on the surface of rollers 5 or 8 so that it doesn't interfere with the formation and deposition. The support and finger are therefore outside the space occupied by the folding ribbon, while the finger 1 is ready to be brought into its operational position, in which it is partially inserted between the loops and therefore between the napkins which will be formed after the cutting of loops. As it can better be seen in FIG. 3, the loops 12 of the ribbon 11, folded in the previously described manner, are deposited by the rollers 5 and 8 in a space adjacent to and below the finger 1, without the same finger, engaged by the stop 3, interfering in their formation. As new loops are formed, the pressure-bars 14 push them towards the knife 13 which cuts the loops, forming a stack of sheets or napkins 4. After the folding of a predetermined number of loops, selected at will, the stop 3 is automatically disengaged, releasing the support 2. Due to the spring 3', the finger immediately engages the succeeding loop 12, pushing it ahead and leaving the space free for the next loop arriving. At the same time the support 2 and the finger 1 are engaged by the conveyor and pulled along the path first portion parallel to the direction of movement of the napkins 4. During this path first portion, the finger 1 continues to engage the loop 12, which is cut from the ribbon, becoming a sheet or napkin 4.

At a certain point along the path, the predetermined number of sheets or napkins forming a pack defined by two succeeding fingers 1, is removed by a forceps or similar device, at least one of whose jaws uses the finger 1 as a guide.

When the support 2 and finger 1 are free of the napkins, they are then transported by a pneumatic transporter or similar device 7 along the path return portion, to be brought back to the starting position, where the supports are stopped awaiting recommencement of the operating cycle. Such stop comes about preferably through the disengagement from the conveyor means while the support bears against an end stop, waiting for another pneumatic cylinder 17 to push it to its starting position.

Figure 4:
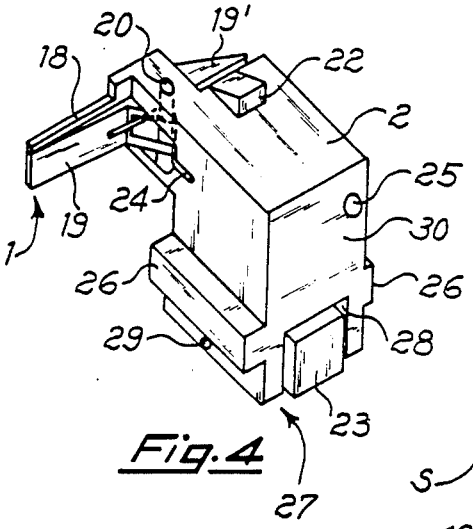
FIG. 4 is a perspective view of a particular embodiment of a separating finger.
Figure 5:
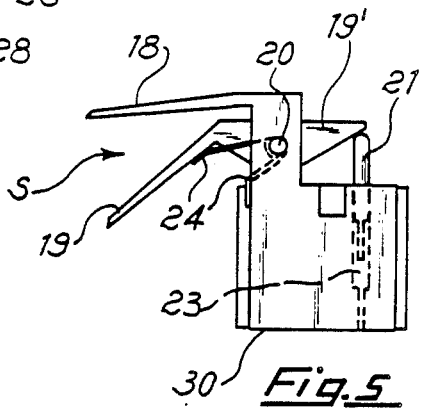
FIG. 5 is a plan view of the separating finger shown in FIG. 4, in its open position.

In a preferred embodiment of the invention, a finger 1 similar to that illustrated in FIGS. 4 and 5 is used. Such a finger 1 is formed by two parts 18 and 19 hinged together by a fulcrum 20. The part 18 is integral with the support 2, while the part 19 is mobile about the fulcrum 20, from a position adjacent to the fixed part 18, or closure position (FIG. 4), and an opening position (as shown in FIG. 5), in which the ends of the two parts 18 and 19 open scissors-like to form a space S. A return spring 24 ensures that the moving part 19 returns to the closure position.

An element 21 is housed in a recess 25 of the support 2 which element can move along the length of the recess towards the end 19' of said mobile part 19. There are two lugs 26 along the side walls of the support, close to the lower face 27 of said support 2 and parallely to the edges formed by the side walls with said lower face 27. In said face 27 there is formed in turn a recess 28 in which an element 23 is housed, which element is in a magnetisable material and is smaller than the recess 28 so to allow a partial rotation thereof round the fulcrum 29 in which it is firmly attached to the support 2.

In said element 23 a housing (not shown) is formed for the fulcrum 29. This housing is larger than the fulcrum itself, therefore allowing easy partial rotation of element 23 itself as well as a limited translational movement thereof in the vertical or horizontal direction. On the upper face of support 2 a tooth or protuberance 22 is provided for, on which the stop for the support itself and related separating finger bears in the starting position.

The operation of the device using the finger shown in FIGS. 4 and 5 is completely analogous to that described with reference to FIGS. 1 to 3.

In more detail, the stop 3 acts on the tooth 22; the support 2 is housed in two side guides along the path 9 by lugs 26, and is moved along said path 9 by a transport tape which moves over one or more fixed magnets. The force exerted by such magnets on the ferromagnetic element 23 is sufficient to maintain the support 2 in contact with the transporter tape and to move the same by the tape without slippings. At a certain point along the path, the two parts 18 and 19 of the finger 1 are separated by acting on the element 21 and therefore on the end 19' of the mobile part 19. The space S formed by the parts 18 and 19 serves as a guide for one of the jaws of a forceps which removes the pack of napkins (or similar products), which is in contact with the part 19 of the finger 1; the forward part of support 2, with reference to the direction of movement along the path portion made with the napkins, is the transverse side 30.

In this case too, the support 2 and related finger 1, once free of the napkins, run a return portion of path 9, to return to the starting point and bear once again against the stop 3. Since the support 2 is moved by said transporter tape, there is no necessity of the aforementioned mechanism to connect or disconnect the support to and from the transport mechanism.

Figure 6:
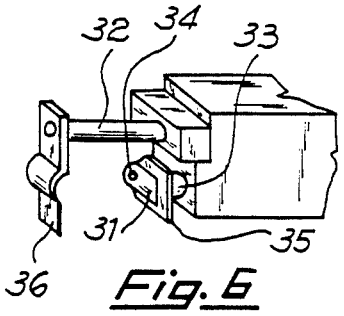
FIG. 6 is a perspective view of a possible forceps for the removal of packs, shown in its resting position.
Figure 7:
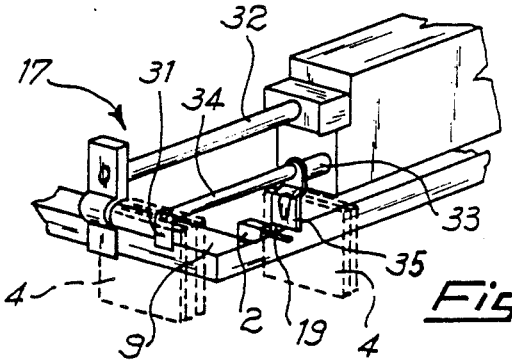
FIG. 7 is a perspective view of the forceps shown in FIG. 6 in its operating position.

FIGS. 6 and 7 show a particular embodiment of a removal forceps. As shown in the above FIGS., the forceps is essentially formed by two jaws, 36 and 31 mounted on respective supports formed by two shafts 32 and 34 respectively. As can be better seen in FIG. 6, jaw 31 cooperates with a limiter element 35 mounted on a shaft 33; in particular, the element 35 is larger than the jaw 31, which is housed partially within the limiter element 35.

The shaft 34, on whose end is mounted the jaw 31, is contained internally in the hollow shaft 33. Said shaft can rotate through at least 90 degrees so that the jaw 31 and the limiter element 35 can assume either a horizontal position (FIG. 6) or a vertical position (FIG. 7). The shaft 32 can move along its own axis between two prefixed points and the shaft 34 can rotate with the shaft 33 and can also move with the shaft 32.

When the pack of napkins 4 reaches the point of path 9 preselected as the end of the travel of support 2, and is located between the finger 1 and jaw 36, an end stop element (not shown) enters the housing 25 of support 2 and displaces the pusher element 21 which acts on the end 19' to distance the finger mobile part 19 from the finger fixed part 18.

At this point the jaw 31 and limiter element 35 are rotated from the position of FIG. 6 to that of FIG. 7, so as to insert the element 35 into the guide formed by the space S between the two parts 18 and 19 of finger 1. The element 35 remains bearing on the finger 1 while the jaw 31 is moved forward pushing the pack of napkins 4 against the jaw 36 and then continues its movement up to a point of pack removal, from which the pack can be sent to packaging.

After the pack removal, the jaws 31 and 36 are returned to the starting position, i.e. the jaw 31 is once again housed in the element 35, on whose rear side there is a new pack of napkins 4, released by the support 2, which has been removed and sent to the return portion of the path 9. The jaw 31, together with the element 35 is then rotated to the stated horizontal position, in which the following pack of napkins can advance up to the jaw 36. The operating cycle is thereafter repeated, bringing a new support 2 into contact with the limiter 35, and so on. It should be noted that the forceps in question can be mounted on a support which allows it to move transversely with respect to the packs of napkins to be formed if they, as in FIGS. 1 and 2, are disposed in two distinct lines. Due to the high production rate of the napkins, more than one support will be needed, which will be moved successively along each path 9. Each support can have one or more fingers 1, depending on whether the leaf-like elements to be separated are more or less large in a direction parallel to the roller axes.

Said supports shall be moved successively in space and time; when the first support is freed from the stop 3 and is moved forward along said path, a second support, located directly behind the first on said path, advances immediately and is engaged by the stop 3, to rest in its starting position, and so on, repeating the operating cycle for each support 2 and related finger or fingers 1. Obviously, the speed of the supports, at least in the path first portion, parallel to the course of the napkins 4, is regulated in function of that of the napkins 4; likewise, the number of supports 2 depends on the preselected number of napkins 4 forming each pack, and can be varied at will, constituting a very flexible and reliably efficient separating system.

I claim:

1. A method for separating a predetermined number of flat objects, in particular loops or leaves of paper being fed from a folder machine of the type comprising rollers which fold a ribbon of paper or similar material forming loops which are afterwards cut to form individual folded leaves, the method being characterized in that it comprises the following steps: blocking by a stop, in a determined position outside the space taken up by the ribbon in the folding phase, at least one support bearing at least one loop or leaf separating finger; retaining said support and related finger by said stop for the time as necessary to build up a predetermined number of loops, starting from an initial loop; disengaging the stop on command and freeing the finger which engages the last loop formed, becoming inserted between this loop and the following one, wherein said stop keeps the support in such as position that the related finger is near a folder roller, and when the support is freed by the stop, it is forced along the path first portion to engage the last loop formed; advancing the support and related finger along a path active portion parallel to that of the loops and leaves obtained from the same loops, substantially at the same speed as said leaves; removing a pack formed by said predetermined number of leaves and defined by the leaves included between said finger and the preceding one sending the support back to its starting position along a path return portion; said phases being carried out simultaneously and successively by a plurality of supports, each having one or a group of separating fingers, the supports being separated one from the other by said predetermined number of leaves or loops along said path active portion.

2. A method according to claim 1 characterized in that the stop is disengaged automatically and in an adjustable way depending on said predetermined number of leaves.

3. A method for separating a predetermined number of flat objects, in particular loops or leaves of paper being fed from a folder machine of the type comprising rollers which fold a ribbon of paper or similar material forming loops which are afterwards cut to form individual folded leaves, the method being characterized in that it comprises the following steps: blocking by a stop, in a determined position outside the space taken up by the ribbon in the folding phase, at least one support bearing at least one loop or leaf separating finger; retaining said support and related finger by said stop for the time as necessary to build up a predetermined number of loops, starting from an initial loop, disengaging the stop on command and freeing the finger which engages the last loop formed, becoming inserted between this loop and the following one; advancing the support and related finger along a path active portion parallel to that of the loops and leaves obtained from the same loops, substantially at the same speed as said leaves; removing with a forceps a pack formed by said predetermined number of leaves and defined by the leaves included between said finger and the preceding one, wherein at least one of the jaws of the forceps is directly or indirectly guided by the separating finger between the leaves of two adjacent packs; sending the support back to its starting position along a path return portion; said phases being carried out simultaneously and successively by a plurality of supports, each having one or a group of separating fingers, the supports being separated one from the other by said predetermined number of leaves or loops along said path active portion.

4. A method for separating a predetermined number of flat objects, in particular loops or leaves of paper being fed from a folder machine of the type compromising rollers which fold a ribbon of paper or similar material forming loops which are afterward cut to form individual folded leaves, the method being characterized in that it compromises the following steps: blocking by a stop, in a determined position outside the space taken up by the ribbon in the folding phase, at least one support bearing at least one loop or leaf separating finger; retaining said support and related finger by said stop for the time as necessary to build up a predetermined number of loops, starting from an initial loop; disengaging the stop on command and freeing the finger which engages the last loop formed, becoming inserted between this loop and the following one, wherein said stop keeps the support in such a position that the related finger is housed in a groove of a folder roller, and when the support is freed by the stop, it is resiliently forced along the path first portion to engage the last loop formed; advancing the support and related finger along a path active portion parallel to that of the loop and leaves obtained from the same loops, substantially at the same speed as said leaves; removing a pack formed by said predetermined number of leaves and defined by the leaves included between said finger and the preceding one; sending the support back to its starting position along a path return portion; said phases being carried out simultaneously and successively by a plurality of supports, each having one or a group of separating fingers, the supports being separated one from the other by said predetermined number of leaves or loops along said path active portion.

5. A method according to claim 4, characterized in that the stop is disengaged to automatically end in an adjustable way depending on said determined number of leaves.

6. A method according to claim 5, characterized by the use of a finger composed of two parts, one of which is mobile with respect to the support, said mobile part being activated in a preselected point of said path, forming a guide opening for said forceps.

7. A method according to claim 6, characterized in that a limiting element partially housing a first jaw of said forceps is inserted within the guide formed by said two finger parts, said first jaw cooperating with the second jaw of said forceps for the removal and transport of the pack of leaves.

8. A method according to claim 7, characterized in that after said leaf pack removal, said jaws are returned to their starting position, said first jaw housing at least in part in said limiting element.

9. A method according to claim 8, characterized by the engagement and disengagement of said limiter element and said first jaw within and from said guide, by a rotational movement round the support axis of said element and jaw.

10. A device for separating a predetermined number of flat objects, in particular sheets of paper in output from a folder machine of the type comprising rollers which fold a ribbon of paper or similar material forming loops which are afterwards cut to form individual folded leaves, the device being characterized in that it comprises: one or more supports each having at least one sheet separating finger; a stop, to keep one of the supports and its related finger or fingers in a waiting position behind the loop formation space, said stop being able to be disengaged on command to allow the finger(s) to reach an operating position between the loops or sheets formed; means for keeping the support or supports close to said waiting position; and means for selectively moving the support or supports along a closed path having a portion parallel to the sheet advancing direction and a return portion.

11. A device according to claim 10, characterized in that it comprises a plurality of supports, each having at least one finger.

12. A device according to claim 11, characterized in that every support presents several fingers aligned along an axis parallel to that of the folding rollers.

13. A device according to one claim 12, characterized in that, in said waiting position, each finger is partially housed in a circumferential groove formed in one of the rollers of said folder.

14. A device according to claim 13, characterized in that the support has resilient means to push the same towards said path, once freed from said stop.

15. A device according to claim 10, characterized in that every finger is comprised of a fixed part and a moving part connected by a fulcrum, and the support has a pushing element for actuating said mobile part to distance the ends of said mobile and fixed parts, and includes a spring to return the mobile part to a position adjacent to the fixed part.

16. A device according to claim 15, including forceps to remove a pack of sheets.

17. A device according to claim 16, characterized in that said forceps has two jaws, the first of said jaws being partially housed, in the rest position, in a limiter element.

18. A device according to claim 17, characterized in that said jaws are mounted on two shafts both mobile along their axes, and in that said first jaw is also rotatable, together with its supporting shaft, around the axis of the latter.

19. A device according to claim 18, characterized in that said limiter element is rotatable along with said first jaw.

20. A device according to claim 17, characterized in that said opening formed by said pushing element between the mobile part and the fixed part of the finger forms the aforementioned guide for said limiter element housing said jaw of the removal forceps.

21. A device for separating a predetermined number of flat objects, in particular sheets of paper in output from a folder machine of the type comprising rollers which fold a ribbon of paper or similar material forming loops which are afterwards cut to form individual folded leaves, the device being characterized in that it comprises: one or more supports each having at least one sheet separating finger; a stop, to keep one of the supports and its related finger or fingers in a waiting position behind the loop formation space, said stop being able to be disengaged on command to allow the finger(s) to reach an operating position between the loops or sheets formed; and means to move the support or supports along a closed path having a portion parallel to the sheet advancing direction and a return portion, wherein said means for moving the supports along a closed path consist of a mobile transporter tape, on which a magnetic attraction is exercised by a component housed under the tape and by elements carried by the supports.

* * * * *

UNITED STATES PATENT AND TRADEMARK OFFICE

CERTIFICATE OF CORRECTION

PATENT NO. : 4,938,465

DATED : July 3, 1990

INVENTOR(S) : Gianni Marsiletti

It is certified that error appears in the above-identified patent and that said Letters Patent is hereby corrected as shown below:

Column 3, Line 9, "an" should read --and--

Column 7, Lines 19-20, "compromising" should read --comprising--

Column 7, Line 23, "compromises" should read --comprises--

Column 8, Line 29, "12," should read --11,--

Signed and Sealed this

Seventeenth Day of September, 1991

*Attest:*

HARRY F. MANBECK, JR.

*Attesting Officer*

*Commissioner of Patents and Trademarks*